US012168876B2

(12) United States Patent
Lindsay et al.

(10) Patent No.: US 12,168,876 B2
(45) Date of Patent: Dec. 17, 2024

(54) FACADE CLADDING FIXING SYSTEM

(71) Applicant: PITTSBURGH CORNING EUROPE NV, Tessenderlo (BE)

(72) Inventors: Clive T. Lindsay, Tessenderlo (BE); Andrew Jones, Tessenderlo (BE); Piet Vitse, Tessenderlo (BE); Marc Clynhens, Tessenderlo (BE); Els Bleus, Tessenderlo (BE)

(73) Assignee: PITTSBURGH CORNING EUROPE NV, Tessenderlo (BE)

( * ) Notice: Subject to any disclaimer, the term of this patent is extended or adjusted under 35 U.S.C. 154(b) by 537 days.

(21) Appl. No.: 17/424,020

(22) PCT Filed: Jan. 23, 2020

(86) PCT No.: PCT/EP2020/051662
§ 371 (c)(1),
(2) Date: Jul. 19, 2021

(87) PCT Pub. No.: WO2020/152287
PCT Pub. Date: Jul. 30, 2020

(65) Prior Publication Data

US 2022/0127861 A1 Apr. 28, 2022

(30) Foreign Application Priority Data

Jan. 25, 2019 (EP) ..... 19153770

(51) Int. Cl.
*E04F 13/08* (2006.01)
*E04B 1/76* (2006.01)

(52) U.S. Cl.
CPC ..... *E04F 13/0805* (2013.01); *E04B 1/7629* (2013.01)

(58) Field of Classification Search
CPC .... E04B 1/7633; E04B 1/7629; E04B 1/7637; E04B 1/7612; E04B 1/7616; E04B 1/762;
(Continued)

(56) References Cited

U.S. PATENT DOCUMENTS 4,576,532 A * 3/1986 Hanson ..... F16B 21/088 110/336
4,693,653 A * 9/1987 Schubert ..... B25B 21/007 52/410
(Continued)

FOREIGN PATENT DOCUMENTS

CN 106545145 A 3/2017
CN 106836702 A 6/2017
(Continued)

OTHER PUBLICATIONS

Office Action from Chinese Application No. 2020800073203 dated Aug. 10, 2022.
(Continued)

*Primary Examiner* — Jessica L Laux
(74) *Attorney, Agent, or Firm* — Calfee, Halter & Griswold LLP

(57) ABSTRACT

Described herein is a cladding fixing system for affixing a cladding structure to a load-bearing substrate of a building having an insulation material, the total cross section of thermally conductive elements of the cladding fixing system extending from the insulation abutting surface of the base plate 100% or more of the insulation material body thickness is 500 $mm^2$ or less per square metre of insulation material when installed, a cladding system including the cladding fixing system and an insulation material body, a method of attaching a cladding structure to a load-bearing substrate of
(Continued)

a building using the cladding fixing system and system described herein and a building with a cladding system installed.

15 Claims, 6 Drawing Sheets

(58) Field of Classification Search
CPC ..... E04B 1/76933; E04F 13/0805; E04F 13/0801; E04F 13/075; E04F 13/077; E04F 13/08; E04F 13/0803; E04F 13/0816; E04F 13/0817; E04F 13/0832; E04F 13/0833; E04F 13/0835; E04F 13/0837
See application file for complete search history.

(56) References Cited

U.S. PATENT DOCUMENTS

| | | | | |
|---|---|---|---|---|
| 5,426,905 | A * | 6/1995 | Rollhauser | F16B 35/00 52/410 |
| 5,632,585 | A * | 5/1997 | Kluser | E04F 13/0835 411/441 |
| 8,387,324 | B2 | 3/2013 | Holm et al. | |
| 9,309,915 | B1 * | 4/2016 | Rodenhouse | B25C 7/00 |
| 9,631,667 | B2 * | 4/2017 | Rodenhouse | F16B 43/00 |
| 9,945,414 | B1 * | 4/2018 | Rodenhouse | F16B 43/001 |
| 10,876,285 | B1 * | 12/2020 | Wigboldy | E04B 1/4178 |
| 2010/0115872 | A1 | 5/2010 | Holm et al. | |
| 2013/0312347 | A1 | 11/2013 | Milostic et al. | |
| 2016/0076257 | A1 | 3/2016 | Le Madec | |
| 2016/0252129 | A1 * | 9/2016 | Rodenhouse | F16B 43/00 411/533 |
| 2016/0273218 | A1 | 9/2016 | Gaydos et al. | |

FOREIGN PATENT DOCUMENTS

| | | | |
|---|---|---|---|
| CN | 107780567 | A | 3/2018 |
| DE | 102010019680 | A1 | 7/2011 |
| EP | 0919674 | A1 | 6/1999 |
| EP | 2423402 | A2 | 2/2012 |
| EP | 2423402 | A3 | 6/2012 |
| EP | 2853652 | A1 | 4/2015 |
| FR | 2540165 | A1 | 8/1984 |
| FR | 2998602 | A1 | 5/2014 |
| KR | 101741427 | B1 | 5/2017 |
| KR | 20170142852 | A | 12/2017 |
| KR | 101915107 | B1 | 11/2018 |
| KR | 20180130973 | A | 12/2018 |
| RU | 121842 | U1 | 11/2012 |
| WO | 2008128733 | A1 | 10/2008 |
| WO | 2008142667 | A1 | 11/2008 |
| WO | 2008142667 | A8 | 12/2009 |
| WO | 2009153767 | A1 | 12/2009 |
| WO | 2010136737 | A1 | 12/2010 |
| WO | 2011154929 | A2 | 12/2011 |
| WO | 2013092848 | A2 | 6/2013 |
| WO | 2014077514 | A1 | 5/2014 |
| WO | 2016207648 | A1 | 12/2016 |

OTHER PUBLICATIONS

Extended European Search Report from EP 19153770.3 dated Jul. 5, 2019.
International Search Report and Written Opinion from PCT/EP2020/051662 dated Mar. 23, 2020.
Office Action from Russian Application No. 2021122457 dated Nov. 22, 2021.
Office Action from Eurasian Application No. 202291042 dated Dec. 6, 2022.
Office Action from EP Application No. 20701468.9 dated Mar. 25, 2024.

* cited by examiner

FACADE CLADDING FIXING SYSTEM

CROSS-REFERENCE TO RELATED APPLICATIONS

This application is the U.S. national stage entry of International Application No. PCT/EP2020/051662, filed Jan. 23, 2020, which claims priority to and the benefit of European Application No. 19153770.3, filed Jan. 25, 2019, the entire contents of which are incorporated by reference herein.

FIELD OF THE INVENTION

The present invention relates to façade cladding fixing systems and, in particular, to their uses for secure building façade cladding to a building.

BACKGROUND

Exterior cladding (also known as façade cladding or rainscreen cladding) is a protective layer of materials that separates a building's structure and interior from exterior elements, such as weather and sound. Cladding systems typically include façade panels mounted on a frame (also known as cladding rails) attached to a load-bearing wall or structure by several brackets.

A cladding zone can be defined between the outside of the load-bearing wall and the interior of the cladding panel. The cladding zone may include one or more layers of insulating material, such as plastic or wool insulation, adjacent to the exterior of the load-bearing wall or structure. An air gap may exist between the insulation material and the interior of the cladding panel. The cladding panel and frame is typically attached to the load-bearing wall by brackets that extend from the cladding panel/channel to the load-bearing wall through the cladding zone.

The weight of façade cladding typically ranges from about 15 kg/m$^2$ to about 80 kg/m$^2$. The façade cladding fixing systems must support the weight of the façade cladding and transfer the load to the load-bearing wall. Wind forces may also apply load on the façade cladding fixing systems. Typically, at least four brackets per m$^2$ of cladding are used to secure the façade panels and supports to the load-bearing walls.

EP 0 919 674 A1 describes a supporting element for the substructure of a ventilated façade with an insulating layer. The supporting element has a fixing part to attach to the outer cladding structure and kink-resistant spacer elements extending from the fixing part to a load-bearing wall through the insulation layer to provide transfer of some of the load from the cladding to the load-bearing wall.

WO 2008/142667 A1 describes support system for mounting building façade elements to a framework. The system includes brackets and fixings for mounting the brackets.

The fixings include a frame fixing element, a spacer section and a bracket fixing element.

Nvelope™ provide rainscreen cladding systems with façade cladding fixing systems. The Nvelope brackets are typically fastened to the load bearing wall and extend through an insulation layer to expose an end of the bracket to fasten to the façade cladding rail. The part of the bracket extending through the insulation has, when installed, typical dimensions of 5 to 6 mm wide, about 40 mm high and between about 40 to 350 mm deep. Several versions of the bracket are available with different depths depending on the thickness of the insulating layer. In this way, a suitable bracket depth may be selected to allow the bracket to fully penetrate through the insulation layer.

A thermal bridge (sometimes referred to as thermal bridging, a cold bridge or thermal bypass) describes a situation in a building where there is a direct connection between the inside and outside through one or more elements that are more thermally conductive than the rest of the building envelope. As such, thermal bridging may occur where cladding systems, such as those described above, penetrate through the thermal insulation material on a building.

While it is desirable to reduce thermal bridging related to a façade cladding system, it is important for the cladding system to fully support the load of the façade cladding and any external forces (such as winds) that are exerted on the cladding. In this way, the structural integrity of the cladding system must be maintained. The load of typical cladding systems may be in the region of 15 to 80 kg/m$^2$ of cladding, with external forces effectively adding further load.

A number of systems are known to attempt to reduce thermal bridging in façade cladding systems. For example, FR 2 998 602 A1 describes a cladding fixing system whereby a base plate 31 is designed to abut the load-bearing wall of the building so that screws or studs 7 be used to fix the bracket to the wall. A tapered cladding rail bracket 32 extends through the, for example, compressible glass wool insulation material 1.

In addition, the fire resistance of exterior cladding has come under close scrutiny in recent years, especially following the fire at Grenfell Tower in London in 2017. The rapid spread of the fire at Grenfell Tower may be linked to the building's exterior cladding. The insulated aluminium cladding cassettes may have allowed the fire to spread across many floors of the building. There is a need to provide incombustible cladding systems, especially for "high-rise" buildings, which adequately support the cladding systems.

SUMMARY OF THE INVENTION

The present invention has been made considering the above issues. In particular, the present invention seeks to provide a façade cladding fixing system that supports façade cladding while providing good fire resistance and/or limiting the thermal bridging caused by the cladding fixing system.

At its most general, the present invention provides a façade cladding system including a rigid insulation material body, a cladding fixing system where the minimum cross-section of thermally conductive material of the cladding fixing system extends completely through the insulation material body.

In a first aspect, the present invention provides a façade cladding system comprising an insulation material body and a cladding fixing system;

wherein the insulation material body has an inner insulation material body surface for facing a load-bearing substrate of a building and an outer insulation material body surface opposite to the inner insulation material body surface, and the insulation material body has an insulation material body thickness as measured from the inner surface to the outer surface of the insulation material body, and the insulation material body exhibits less than 10% deformation under a compressive pressure of 400 kPa as measured by in accordance with EN 826;

the cladding fixing system has a base plate with an insulation abutting surface for abutting the outer surface of the insulation material body, and at least one load-bearing fixing extending from the base plate and for fixing the base plate to the load-bearing substrate through the base plate;

the or each load-bearing fixing has a length greater than the insulation material body thickness for extending from the base plate through the insulation body material and into the load-bearing substrate; and the total cross section of thermally conductive elements of the cladding fixing system extending from the insulation abutting surface of the base plate 100% or more of the insulation material body thickness is less than 500 $mm^2$ per square metre of insulation material.

In a particular embodiment of the first aspect, only the load-bearing fixing or fixings of the cladding fixing system extend from the base plate 100% or more of the insulation material body thickness.

In a second aspect, the present invention provides a cladding fixing system for affixing a cladding structure to a load-bearing substrate of a building having an insulation material body, the cladding fixing system comprising:

a base plate and at least one load-bearing fixing for fixing the base plate to a load-bearing substrate at a first distance from the load-bearing substrate;

the or each load-bearing fixing has a length equal to or greater than the first distance and configured to fix the base plate to the load-bearing substrate; and the total cross section of thermally conductive elements of the cladding fixing system extending the length of the first distance or more from the base plate towards the load-bearing substrate is 500 $mm^2$ or less per square metre of the building surface when installed.

In a particular embodiments of the cladding fixing system of the second aspect, the load-bearing fixing or fixings are the only part of the cladding fixing system that extends the length of the first distance or more from the base plate towards the load-bearing substrate when installed. In these embodiments, it may be that only the load-bearing fixing or fixings extend more than 50% of the first distance from the base plate towards the load-bearing substrate when installed.

In some embodiments of the cladding fixing system of the second aspect, the cladding fixing system further comprising a cladding rail bracket for fixing a cladding rail to the base plate, wherein the cladding rail bracket is fixable to the base plate on an opposite side of the base plate to the load-bearing structure, wherein the cladding rail bracket does not extend from the base plate towards the load-bearing structure when installed.

In a further aspect, the present invention provides a cladding fixing system for affixing a cladding structure to a load-bearing substrate of a building having an insulation material body with a thickness of 150 mm or more, the cladding fixing system comprising:

a base plate with an insulation abutting surface for abutting the outer surface of the insulation material body and at least one load-bearing fixing for fixing the base plate to a load-bearing substrate;

the or each load-bearing fixing extend at least 150 mm from the insulation abutting surface of the base plate and is configured to fix the base plate to the load-bearing substrate; and the total cross section of thermally conductive elements of the cladding fixing system extending at least 150 mm from the insulation abutting surface of the base plate is 500 $mm^2$ or less.

In another aspect, the present invention provides a cladding fixing system for affixing a cladding structure to a load-bearing substrate of a building having an insulation material body, the cladding fixing system comprising:

a base plate with an insulation abutting surface for abutting the outer surface of the insulation material body and at least one load-bearing fixing for fixing the base plate to a load-bearing substrate;

the or each load-bearing fixing is configured to extend through the entire thickness of the insulation material body and configured to fix the base plate to the load-bearing substrate; and the total cross section of thermally conductive elements of the cladding fixing system extending from the insulation abutting surface of the base plate 100% or more of the insulation material body thickness is 500 $mm^2$ or less per square metre of insulation material when installed.

In a third aspect, the present invention provides a method of attaching a cladding structure to a load-bearing substrate of a building, the method comprising the steps of:

a) Attaching one or more insulation material bodies to the load-bearing substrate of the building, wherein each insulation material body has an inner insulation material body surface for facing a load-bearing substrate of a building and an outer insulation material body surface opposite to the inner insulation material body surface, and the insulation material body has an insulation material body thickness as measured from an inner surface of the insulation material body to an outer surface of the insulation material body, and the insulation material body exhibits less than 10% deformation under a compressive pressure of 400 kPa as measured by in accordance with EN 826;

b) Attaching one or more cladding fixing systems through the insulation material body to the load-bearing substrate of the building; each cladding fixing system having a base plate with an insulation abutting surface for abutting the outer surface of the insulation material body and at least one load-bearing fixing for fixing the base plate to the load-bearing substrate; the or each load-bearing fixing has a length greater than the insulation material body thickness for extending from the base plate through the insulation body material to the load-bearing substrate, and the total cross section of thermally conductive elements of the cladding fixing system extending 100% or more of the insulation material body thickness from the insulation abutting surface of the base plate is 500 $mm^2$ or less per square metre of insulation material; and c) affixing a cladding panel structure to the cladding fixing system.

The cladding panel structure may include one or more cladding rails and one or more cladding panels. Typically, the cladding fixing system includes a cladding rail bracket for affixing a cladding rail to the cladding fixing system.

In a fourth aspect, the present invention provides the use of the façade cladding system of the first aspect or a cladding fixing system of the second aspect in the cladding of a building.

In a fifth aspect, the present invention provides a building including a façade cladding system of the first aspect installed.

DETAILED DESCRIPTION

The invention will be described in detail with reference to the accompanying Figures.

Figure 1:
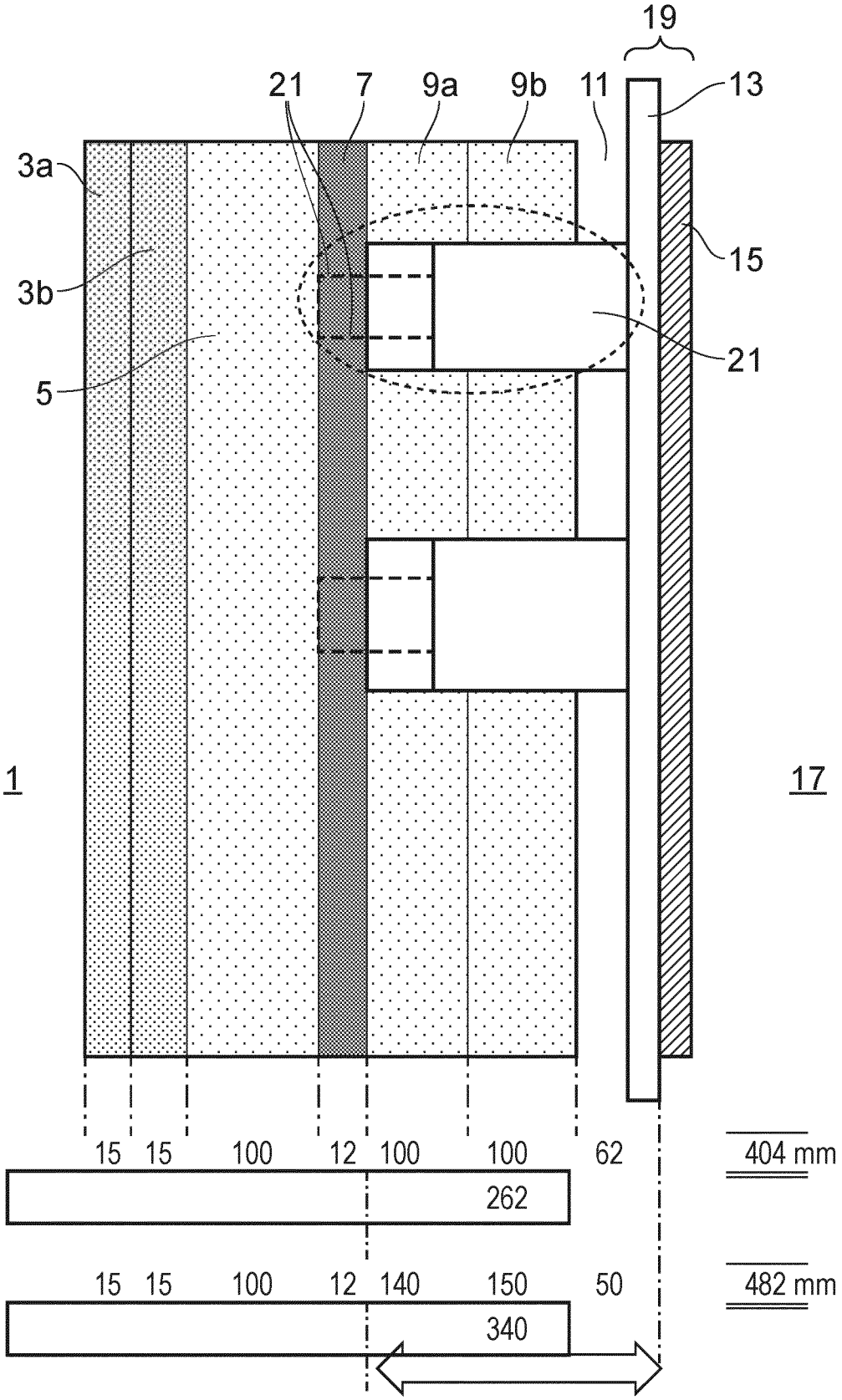
FIG. 1 shows a schematic of a cut-through showing the fixing of a cladding structure to the exterior of a building using a cladding fixing system of the type sold by Nvelope®.

The façade cladding system described herein comprises an insulation material body and a cladding fixing system including a base plate.

Insulation Material Body

The affixing of an insulation material body to the outer surface of a building structure, such as an outer wall, is known and a suitable insulation material body may be selected from such known insulation materials.

Typically, a plurality of insulation material bodies (such as slabs, blocks, strips or rolls) are affixed to the outer surface of a building structure to provide insulation to the building structure.

Insulation Material Body Thickness

When the cladding has been installed on a building, an inner surface of the insulation material body abuts the outer surface of the building structure and an outer surface of the insulation material body faces the cladding panel or panels. The distance between the inner surface and the outer surface of the insulation material body determines the insulation material body thickness. For any given insulation material, the insulation material body thickness will determine the insulating effect on the building. In other words, the insulating effect on the building can be tailored by adjusting the insulation material body thickness. In general, the greater the insulation material thickness, the greater the insulating effect for any given insulation material.

In some embodiments, the insulation material body is made up of more than one insulation material unit with the inner surface of the insulation material body being an inner surface of a first insulation material unit and the outer surface of the insulation material body being an outer surface of a second insulation material unit. In other words, the insulation material body may include two or more insulation material units and at least two insulation units contribute to the insulation material body thickness.

The insulation material body thickness is not particularly limited. The insulation material body thickness may be at least 30 mm. In some embodiments, the insulation material body thickness is at least 60 mm. In particular embodiments, the insulation material body thickness is at least 100 mm. In more particular embodiments, the insulation material body thickness is at least 150 mm. In some embodiments, the insulation material body thickness is no more than 400 mm. In particular embodiments, the insulation material body thickness is no more than 350 mm. In more particular embodiments, the insulation material body thickness is no more than 300 mm. In even more particular embodiments, the insulation material body thickness is no more than 250 mm. In some embodiments, the insulation material body thickness is in the range of 30 mm to 400 mm. In more particular embodiments, the insulation material body thickness is in the range of 100 mm to 300 mm. In even more particular embodiments, the insulation material body thickness is in the range of 150 mm to 250 mm.

The insulation material body thickness will generally be determined by the desired insulating effect. The thermal insulating effect may be expressed as the U-value. The U-value is the result of the total thermal insulating effect of the cladding system, including insulating or conducting effects from, for example, the insulation material, any air gap between the insulation material and the cladding panel, and/or the cladding fixing system. In some embodiments, the insulation material body is selected to provide a thermal insulation U-value of no more than 0.50 $W/m^2K$. In particular embodiments, the insulation material body is selected to provide a thermal insulation U-value of no more than 0.30 $W/m^2K$. In more particular embodiments, the insulation material body is selected to provide a thermal insulation U-value of no more than 0.22 $W/m^2K$. In even more particular embodiments, the insulation material body is selected to provide a thermal insulation U-value of no more than 0.18 $W/m^2K$. In yet more particular embodiments, the insulation material body is selected to provide a thermal insulation U-value of no more than 0.15 $W/m^2K$. In some embodiments, the insulation material body is selected to provide a thermal insulation U-value of 0.10 $W/m^2K$ or more. In other embodiments, the insulation material body is selected to provide a thermal insulation U-value of 0.05 $W/m^2K$ or more.

In some embodiments, the insulation material body provides a thermal insulation U-value in the range of 0.10 $W/m^2K$ to 0.30 $W/m^2K$. In particular embodiments, the insulation material body provides a thermal insulation U-value in the range of 0.10 $W/m^2K$ to 0.20 $W/m^2K$.

The insulation material body thickness can be selected for a given material to achieve a desired U-value for the cladding system. For example, a U-value of 0.13 may be achieved using a slab of cellular glass with a thickness of 200 mm and an air gap of 62 mm (placed in that order from outer surface of the building structure to the interior of the cladding panel). Alternative configurations and insulating materials are possible to achieve the same U-value. For example, a U-value of 0.13 may be achieved using a first slab of mineral wool with a thickness of 140 mm, a second slab of mineral wool with a thickness of 150 mm and an air gap of 50 mm (placed in that order from outer surface of the building structure to the interior of the cladding panel). However, the other features of the insulation material body, such as the deformation must be taken into consideration.

Deformation

The insulation material body exhibits less than 10% deformation under a compressive pressure of 400 kPa as measured by in accordance with EN 826. In other words, the thickness of the insulation material body, d, under a compressive pressure of 400 kPa is more than 90% of the thickness of the insulation material body under a preload pressure, $d_0$, as measured by test EN 826.

While the load-bearing fixings of the cladding fixing system take most, if not all, of the load from the cladding panel structure, the insulation material having a relatively low deformation at a compressive pressure of 400 kPa provides stability to the cladding fixing system.

The compressive strength for insulation materials in accordance EN 826 is measured by compressing the material until the specimen yields or until a strain of 10% is reached. In other words, the compressive strength may be recorded as the pressure (force/cross-sectional area of sample) required to compress the sample by 10% of the original thickness of the sample. As such, any insulation material that is reported to have a compressive strength at 10% compression of 400 kPa or less does not exhibit less than 10% deformation under a compressive pressure of 400 kPa as measured by in accordance with EN 826. In other words, a compressive strength at 10% compression of less than 400 kPa will exhibit more than 10% deformation at 400 kPa. For the avoidance of doubt, any insulation material that yields at a compressive pressure of less than 400 kPa is also not considered to exhibit less than 10% deformation under a compressive pressure of 400 kPa as measured by in accordance with EN 826. In other words, the insulation material body of the present invention has a compressive strength of 400 kPa or more.

Typical compressive strength values at 10% compression for glass wool, rockwool, expanded polystyrene and polyurethane insulation materials may be significantly less than 400 kPa. Celullar glass insulation materials typically have a compressive strength of above 400 kPa. Extruded polystyrene insulation material may also have a compressive strength value at 10% compression of 400 kPa or more.

In some embodiments, the insulation material body exhibits 5% or less deformation under a compressive pressure of 400 kPa as measured by in accordance with EN 826. In particular embodiments, the insulation material body exhibits 3% or less deformation under a compressive pressure of 400 kPa as measured by in accordance with EN 826. In more particular embodiments, the insulation material body exhibits 2% or less deformation under a compressive pressure of 400 kPa as measured by in accordance with EN 826. In yet more particular embodiments, the insulation material body exhibits 1% or less deformation under a compressive pressure of 400 kPa as measured by in accordance with EN 826.

In other embodiments, the insulation material body exhibits less than 10% deformation under a compressive pressure of 500 kPa as measured by in accordance with EN 826. In more particular embodiments, the insulation material body exhibits less than 10% deformation under a compressive pressure of 600 kPa as measured by in accordance with EN 826. In even more particular embodiments, the insulation material body exhibits less than 10% deformation under a compressive pressure of 700 kPa as measured by in accordance with EN 826.

In a particular embodiment, the insulation material body exhibits 2% or less deformation under a compressive pressure of 600 kPa as measured by in accordance with EN 826.

Non-Combustibility

In some embodiments, the insulation material body may consist of materials having a rating of A1, A2 or B according to the Euroclass fire reaction classification according to EN 13501-1.

The European Reaction to Fire classification system (Euroclasses) is the EU common standard for assessing the qualities of building materials in the event of fire. The Euroclasses were introduced following a resolution by the Commission (2000/147/EEC) from Feb. 8, 2000 to create a common platform for the comparison of the fire properties of construction materials. Fire reaction of the products is conducted in accordance with harmonised testing methods, namely EN 13501-1.

The Euroclass system classes materials into one of seven categorisations from A1 to F. The materials of the insulation body have a classification of A1, A2 or B according to the Euroclass system.

Examples of insulation materials with an A1 classification include, but are not limited to, fiberglass or glass wool, mineral wool and cellular glass. Examples of materials with an A2 classification according to the Euroclass system may include, but are not limited to, materials with a classification of A1 including up to 10% wt. of organic compounds. Examples of materials with a B classification include, but are not limited to, gypsum boards with surface linings.

In particular embodiments, the insulation material body has a classification of A1 or A2 according to the Euroclass system. Classification A1 and A2 are the two highest classifications in the Euroclass system and are classed as non-combustible. Such materials are particularly useful where the façade cladding system is to be used in buildings having (i) four or more floors or (ii) one to three floors and a height of at least 15 metres. In some embodiments, the building has a height of a height of at least 15 metres. In general, such buildings may be classified as high-rise buildings.

Cellular Glass

In particular embodiments, the insulation material body is a cellular glass body. Cellular glass typically has the required deformation properties required of the insulation material body described herein. In more particular embodiments, the insulation material body is FOAMGLAS® cellular glass insulation. FOAMGLAS® is cellular glass available from Pittsburgh Corning Europe NV.

Cladding Fixing System

The cladding fixing system has a base plate with an insulation abutting surface for abutting the outer surface of the insulation material body and at least one load-bearing fixing for fixing the base plate (and therefore the cladding fixing system) to a load-bearing substrate. In particular embodiments, the cladding fixing system further includes a cladding rail bracket for affixing a cladding rail to the cladding fixing system.

Total Cross-Section

The total cross section of thermally conductive elements of the cladding fixing system that extends 100% or more of the insulation material body thickness from the base plate through the insulation material is 500 $mm^2$ or less per square metre of insulation material.

The present invention aims to reduce the conductance of heat from the cladding structure at the exterior of the building to the load-bearing substrate of the building. The present inventors believe that the limiting the cross-section of thermally conductive material from the cladding fixing system that extends from the outside of the insulation material and all the way through the insulation material to the load-bearing substrate of the building can significantly reduce thermal conductance from the cladding structure to the building. In this way, thermal bridging may be reduced and the fire safety of the cladding structure may be maintained.

The cross-section of the cladding fixing system that extends 100% or more of the insulation material body thickness from the base plate through the insulation material is the cross-section of the any thermally conductive part of the cladding fixing system that extends all the way through the insulation material from the base plate. The cross-section is the total cross-section of these parts in a plane perpendicular to the line from the base plate through the insulation material body.

The thermally conductive elements of the cladding fixing system are easily identifiable by their material. Thermally conductive materials are known per se. Thermally conductive materials typically have a thermal conductivity of 10 W/(mK) or more. In particular embodiments, the thermally conductive elements are the metallic portions of the cladding fixing system.

The total cross-section of thermally conductive elements of the cladding fixing system that extends 100% or more of the insulation material body thickness from the base plate through the insulation material per square metre of insulation material may easily be calculated as follows. The total cross-section of thermally conductive elements that extend 100% or more of the insulation material body thickness from the base plate through the insulation material can be measured or calculated for each cladding fixing system used on a surface of a building to be clad. The total cross-section of thermally conductive elements of each cladding fixing systems can then be summed and divided by the surface area to be clad of the surface of the building.

The cladding fixing systems may be uniformly distributed over a cladded area. Alternatively, there may be a greater density of cladding fixing systems where the load on the cladding system is likely to be highest (e.g. due to high winds).

In some embodiments, the total cross section of thermally conductive elements of the cladding fixing system that extends 100% or more of the insulation material body thickness from the base plate through the insulation material is 400 $mm^2$ or less per square metre of insulation material. In particular embodiments, the total cross section of thermally conductive elements of the cladding fixing system that extends 100% or more of the insulation material body thickness from the base plate through the insulation material is 300 $mm^2$ or less per square metre of insulation material. In more particular embodiments, the total cross section of thermally conductive elements of the cladding fixing system that extends 100% or more of the insulation material body thickness from the base plate through the insulation material is 200 $mm^2$ or less per square metre of insulation material. In even more particular embodiments, the total cross section of thermally conductive elements of the cladding fixing system that extends 100% or more of the insulation material body thickness from the base plate through the insulation material is 100 $mm^2$ or less per square metre of insulation material. In yet further particular embodiments, the total cross section of thermally conductive elements of the cladding fixing system that extends 100% or more of the insulation material body thickness from the base plate through the insulation material is 50 $mm^2$ or less per square metre of insulation material.

Base Plate

The base plate has an insulation abutting surface for abutting the outer surface of the insulation material body. As such, the base plate, when installed, is positioned on the opposite surface of the insulation material body to the load-bearing substrate (e.g. wall of the building). The insulation abutting surface of the base plate is typically in direct contact with the outer surface of the insulation material body. The relative resistance to deformation of the insulation material body as defined herein may therefore provide relative resistance to movement of the base plate. As a result, the combination of the base plate (with its insulation abutting surface) being positioned outside of the insulation material body and the relative resistance to the deformation of the insulation material body may provide stability to the cladding fixing system.

The base plate may have one or more insulation abutting surfaces that abut the outer surface of the insulation material body. In a particular embodiment, the insulation abutting surface or surfaces form at least 50% by surface area of surfaces of the base plate that face the outer surface of the insulation material body. In other words, the base plate may have one or more inner surfaces that face or oppose the outer surface of the insulation material body. The insulation abutting surface or surfaces of the base plate may form 50% or more by surface area of the inner surface or surfaces of the base plate. In this way, a significant proportion of the base plate inner surface is configured to be in contact with the outer surface of the insulation material body. In particular embodiments, the insulation abutting surface or surfaces form at least 70% by surface area of surfaces of the base plate that face the outer surface of the insulation material body. In more particular embodiments, the insulation abutting surface or surfaces form at least 80% by surface area of surfaces of the base plate that face the outer surface of the insulation material body. In yet more particular embodiments, the insulation abutting surface or surfaces form at least 90% by surface area of surfaces of the base plate that face the outer surface of the insulation material body. In even more particular embodiments, the insulation abutting surface or surfaces form at least 95% by surface area of surfaces of the base plate that face the outer surface of the insulation material body. In one particular embodiment, the insulation abutting surface or surfaces form substantially all by surface area of surfaces of the base plate that face the outer surface of the insulation material body.

The insulation abutting surface typically has a complementary shape to the outer surface of insulation material body. In particular embodiments, the outer surface of the insulation material body has a substantially planar surface and the insulation abutting surface is a substantially planar surface. In particular embodiments, the base plate is substantially planar.

The shape and dimensions of the base plate are not particularly limited. When the base plate is substantially planar, the shape of the major plane of the base plate may be circular, elliptical, crescent, oval, triangular, quadrilateral (e.g. square, rectangular, rhombus, rhomboid, oblong), pentagonal, hexagonal, heptagonal, octagonal, a polygon nine or more sides, or an irregular shape. In particular embodiments, the shape of the major plane of the base plate is circular, oval, ellipse, square or rectangular.

The major plane of the base plate will typically have a length and a width.

In some embodiments, the length of the base plate is at least 20 mm. In particular embodiments, the length of the base plate is at least 50 mm. In more particular embodiments the length of the base plate is at least 100 mm. In yet more particular embodiments, the length of the base plate is at least 120 mm. In even more particular embodiments, the length of the base plate is at least 140 mm.

In some embodiments, the length of the base plate is no more than 300 mm. In particular embodiments, the length of the base plate is no more than 250 mm. In more particular embodiments, the length of the base plate is no more than 200 mm. In yet more particular embodiments, the length of the base plate is no more than 180 mm. In even more particular embodiments, the length of the base plate is no more than 160 mm.

In some embodiments, the length of the base plate is in the range of 20 mm to 300 mm. In particular embodiments, the length of the base plate is in the range of 50 mm to 250 mm. In more particular embodiments, the length of the base plate is in the range of 100 mm to 200 mm. In yet more particular embodiments, the length of the base plate is in the range of 120 mm to 180 mm. In even more particular embodiments, the length of the base plate is in the range of 140 mm to 160 mm, or about 150 mm.

In some embodiments, the width of the base plate is at least 20 mm. In particular embodiments, the width of the base plate is at least 50 mm. In more particular embodiments the width of the base plate is at least 100 mm. In yet more particular embodiments, the width of the base plate is at least 120 mm. In even more particular embodiments, the width of the base plate is at least 140 mm.

In some embodiments, the width of the base plate is no more than 300 mm. In particular embodiments, the width of the base plate is no more than 250 mm. In more particular embodiments, the width of the base plate is no more than 200 mm. In yet more particular embodiments, the width of the base plate is no more than 180 mm. In even more particular embodiments, the width of the base plate is no more than 160 mm.

In some embodiments, the width of the base plate is in the range of 20 mm to 300 mm. In particular embodiments, the width of the base plate is in the range of 50 mm to 250 mm. In more particular embodiments, the width of the base plate is in the range of 100 mm to 200 mm. In yet more particular embodiments, the width of the base plate is in the range of 120 mm to 180 mm. In even more particular embodiments, the width of the base plate is in the range of 140 mm to 160 mm, or about 150 mm.

The ratio of the length to the width of the base plate may be in the range of 3:1 to 1:3, 2:1 to 1:2, 1.5:1 to 1:1.5, 1.2:1 to 1:1.2, 1.1:1 to 1:1.1, or about 1.0:1.0.

The thickness of the base plate may be at least 0.1 mm. In some embodiments, the thickness of the base plate is at least 0.25 mm. In particular embodiments, the thickness of the base plate is at least 0.5 mm. In more particular embodiments, the thickness of the base plate is at least 0.75 mm. In some embodiments, the thickness of the base plate is no more than 10 mm. In particular embodiments, the thickness of the base plate is no more than 5 mm. In more particular embodiments, the thickness of the base plate is no more than 2 mm.

In some embodiments, the thickness of the base plate is in the range of 0.1 mm to 10 mm. In particular embodiments, the thickness of the base plate is in the range of 0.25 mm to 5 mm. In more particular embodiments, the thickness of the base plate is in the range of 0.5 mm to 2 mm. In yet more particular embodiments, the thickness of the base plate is about 1 mm.

The base plate may be adapted to receive one or more load-bearing fixings. In some embodiments, the base plate has one or more apertures to receive a load-bearing fixing. Typically, each aperture is adapted to receive a single load-bearing fixing. The aperture may have a cross-section that is up to 25% larger than the corresponding cross-section of the load-bearing fixing. In some embodiments, the aperture or apertures have a diameter in the range of 4.5 mm to 8.5 mm. In particular embodiments, the aperture or apertures have a diameter in the range of 5.5 to 7.5 mm. In more particular embodiments, the aperture or apertures have a diameter in the range of 6 to 7 mm.

Additionally or alternatively, the aperture may have a shape complimentary to the shape of the load-bearing fixing cross-section. The aperture or apertures may be circular, elliptical, crescent, oval, triangular, quadrilateral (e.g. square, rectangular, rhombus, rhomboid, oblong), pentagonal, hexagonal, heptagonal, octagonal, a polygon nine or more sides, or an irregular shape. In particular embodiments, the aperture or apertures have a circular, oval, ellipse, square or rectangular shape. In a particular embodiment, the aperture or apertures have a circular shape.

In particular embodiments, the base plate includes a plurality of apertures for receiving a plurality of load-bearing fixings, wherein, in use, at least two apertures are vertically aligned.

Alternatively, the load-bearing fixings may be integrated into the base plate.

Stability Flange

In some embodiments, the cladding fixing system includes one or more stability flanges extending from the insulation abutting surface of the base plate and the or each stability flange extends no more than 90% of the insulation material body thickness. It is important that any feature of the cladding fixing system (other than the load-bearing fixing or fixings) that extends from the insulation abutting surface of the base plate does not extend through the complete thickness of the insulation material body. In this way, thermal bridging through the insulation material body is minimised.

In some embodiments, the stability flange or flanges extend no more than 75% of the insulation material body thickness from the insulation abutting surface of the base plate. In particular embodiments, the stability flange or flanges extend no more than 50% of the insulation material body thickness from the insulation abutting surface of the base plate. In more particular embodiments, the stability flange or flanges extend no more than 25% of the insulation material body thickness from the insulation abutting surface of the base plate. In even more particular embodiments, the stability flange or flanges extend no more than 10% of the insulation material body thickness from the insulation abutting surface of the base plate.

For insulation material body thicknesses of 2 m or more, the stability flange or flanges may extend 1.8 m or less, particularly, 1.5 m or less, more particularly, 1.0 m or less, even more particularly, 0.5 m or less and yet more particularly 0.25 m or less from the insulation abutting surface of the base plate.

The shape of the stability flange is not particularly limited. In some embodiments, the stability flange or flanges are substantially planar. In these embodiments, a major plane of the stability flange or flanges may be at an angle of 70 to 110° to a major plane of the base plate. In particular embodiments, the major plane of the stability flange or flanges may be at an angle of 80 to 10° to a major plane of the base plate, or substantially perpendicular to a major plane of the base plate.

The stability flange or flanges typically includes a leading edge distal to the insulation abutting surface of the base plate. The leading edge may be the first edge that penetrates the insulation material body when the cladding system is installed. In some embodiments, the leading edge may be serrated. In this way, the leading edge may assist the penetration of the stability flange into the insulation material body.

In particular embodiments, the cladding fixing system includes a first stability flange extending from an edge of the insulation abutting surface of the base plate. During installation of the cladding system, the first stability flange may be arranged at the lower part of the cladding fixing system. In this way, the first stability flange may provide additional stability to the lower part of the cladding fixing system when the downward load from the weight of the cladding structure is put through cladding fixing system when the cladding fixing system is affixed to the cladding fixing system.

In some embodiments, the cladding fixing system includes a first stability flange extending from an edge of the insulation abutting surface of the base plate and a second stability flange extending from an opposing edge of the insulation abutting surface of the base plate.

Cladding Rail Bracket

During installation, the cladding structure is typically fixed to the cladding fixing system. The cladding structure typically includes one or more cladding rails (also known as cladding channels) and one or more cladding panels affixed to the cladding rails. The cladding rails may effectively form a frame onto which the cladding panels are affixed. The cladding fixing system is typically affixed to the cladding rail of the cladding structure. In some embodiments, the cladding fixing system includes a cladding rail bracket for fixing the cladding fixing system to a cladding rail.

The cladding rail bracket typically extends from an outer face of the base plate. The outer face of the base plate is typically the opposite face of the base plate from the insulation material abutting surface. In some embodiments, the cladding fixing system extends from the outer face of the base plate at an angle of 80 to 100° to the major plane of the base plate. In particularly embodiments, the cladding fixing system extends from the outer face of the base plate at a substantially perpendicular angle to the major plane of the base plate.

The cladding rail bracket may extend from the base plate at least the distance required to affix the cladding rail bracket to the cladding rail. Typically there is overlap of the cladding rail bracket and the cladding rail. In this way, the cladding rail may be securely affixed to the cladding fixing system and load from the cladding structure may be transferred to a load-bearing substrate of a building through the cladding fixing system (i.e. cladding rail bracket, base plate and/or load-bearing fixings). The overlap may be in the region of 20 mm to 60 mm. When installed, an air gap may be present between the outer surface of the insulation material and the cladding panel wherein the air gap has a thickness of at least the thickness of the cladding rail. In some embodiments, the cladding rail may abut the base plate of the cladding fixing system and an inner surface of a cladding panel. There are typically regular gaps between cladding rails when installed. In these embodiments, there are areas between cladding rails where an air gap between the cladding panel and the outer surface of the material is the thickness of the base plate and the cladding rail.

The cladding rail bracket may extend an additional length from the base plate. In this way, an additional air gap may be generated between base plate (and therefore the outer surface of the insulation material) and the cladding panel. In particular, the cladding rail bracket may extend a distance of 30 to 100 mm from the base plate. In some embodiments, the cladding rail bracket extends in the range of 50 to 70 mm from the base plate. In this way, an air gap between the cladding rail and the base plate may also exist.

The cladding rail bracket typically is of a material capable of transferring the load of the cladding structure to the load-bearing substrate of the building via the cladding fixing system. In some embodiments, the cladding rail bracket is metal. In particular embodiments, the cladding rail bracket is steel.

The cladding rail bracket may be integral to the base plate. In other words, the base plate and cladding rail bracket may be a single piece of material. In these embodiments, the cladding rail bracket and base plate may be metal, in particular, steel.

Alternatively, the base plate and cladding rail bracket are separate pieces. In this way, a commercially available cladding rail bracket may be used with the base plate as described herein. In use, such a cladding rail bracket may be affixed to the base plate. The cladding rail bracket may be affixed to the base plate by any known fixing, such as one or more nuts and bolts or one or more screws. In some embodiments, the cladding rail bracket is affixed to the base plate through the one or more load-bearing fixings.

Load-Bearing Fixing or Fixings

The load bearing fixing or fixings, in use, transfer most, if not all of the load from the cladding structure to the load-bearing substrate of the building (typically the outer structure of the building). The load-bearing fixing or fixings are typically designed for each specific project, depending on the weight of the cladding and wind loads.

The load-bearing fixing or fixings typically has a proximal end for engaging with the base plate of the cladding fixing system, a mid-section extending through the insulation material body from the base plate to the inner surface of the insulation material body and a distal end for engaging with a load-bearing substrate. The distal end typically protrudes from the inner surface of the insulation material body. In this way, some or all of the distal end of the load-bearing fixing may penetrate the load-bearing substrate to engage with the load-bearing substrate.

In some embodiments, the load-bearing fixing or fixings are capable of bearing at least 90% of the weight of the cladding structure. In particular embodiments, the load-bearing fixing or fixings are capable of bearing at least 95% of the weight of the cladding structure. In more particular embodiments, the load-bearing fixing or fixings are capable of bearing at least 100% of the weight of the cladding structure.

The weight of cladding structures typically vary from 15 to 80 kg/m$^2$ of cladding. In some embodiments, the load-bearing fixing or fixings are capable of bearing at least 50 kg per square metre of cladding. In particular embodiments, the load-bearing fixing or fixings are capable of bearing at least 60 kg per square metre of cladding. In more particular embodiments, the load-bearing fixing or fixings are capable of bearing at least 70 kg per square metre of cladding. In more particular embodiments, the load-bearing fixing or fixings are capable of bearing at least 80 kg per square metre of cladding.

The load of the cladding structure may be borne by a single load-bearing fixing in a square metre of cladding, or the load of the cladding structure may be borne by more than one load-bearing fixing per square metre. Where more than one load-bearing fixing is used per square metre of cladding, the load may be spread between the load-bearing fixings. In other words, each load-bearing fixing may be capable of bearing less than the total load per square metre of cladding, and the total load for any given square metre be shared between the two or more load-bearing fixings located within that square metre of cladding.

In some embodiments, the cladding fixing system includes a plurality of load-bearing fixings. The plurality of load-bearing fixings may help to bear the total load while minimising the cross-section extending entirely through the insulation material. In particular embodiments, the cladding fixing system includes two, three or four load-bearing fixings. In a particular embodiment, the cladding fixing system includes two load-bearing fixings as the sole load-bearing fixings of the cladding fixing system.

The plurality of load-bearing fixings may be arranged, in use, with at least two load-bearing fixings vertically aligned. In this way, the cladding fixing system more easily bears the load of the cladding system.

In some embodiments, the total cross section of the load-bearing fixing or fixings is 500 mm$^2$ or less per square metre of insulation material. In this way, thermal bridging through the load-bearing fixings is reduced as the cross-section of the load bearing fixings per square metre of insulation material is minimised.

In some embodiments, the total cross section of the load-bearing fixing or fixings is 400 $mm^2$ or less per square metre of insulation material. In particular embodiments, the total cross section of the load-bearing fixing or fixings is 300 $mm^2$ or less per square metre of insulation material. In more particular embodiments, the total cross section of the load-bearing fixing or fixings is 200 $mm^2$ or less per square metre of insulation material. In even more particular embodiments, the total cross section of the load-bearing fixing or fixings is 100 $mm^2$ or less per square metre of insulation material. In yet further particular embodiments, the total cross section of the load-bearing fixing or fixings is 50 $mm^2$ or less per square metre of insulation material.

The cross-section of the load-bearing fixing or fixings is the cross-section of the fixings through the fixing in a plane perpendicular to the line from the base plate through the insulation material body.

The total cross-section of the load-bearing fixings per square metre of insulation material may easily be calculated by multiplying the number of fixings in a square metre by the cross-section of a load-bearing fixing within the square metre. In some areas of the cladding system, the cladding fixing systems with load-bearing fixings will be uniformly distributed over a cladded area and load-bearing fixings with the same (or very similar) cross-section used for cladding fixing system. In other areas, such as the corners of the buildings or areas particularly exposed to wind loads, the density of cladding fixing systems may be higher than other areas.

Each load-bearing fixing may have a cross-section in the range of 10 $mm^2$ to 100 $mm^2$. In some embodiments, each load-bearing fixing has a cross-section in the range of 15 $mm^2$ to 75 $mm^2$. In more particular embodiments, each load-bearing fixing has a cross-section in the range of 20 $mm^2$ to 50 $mm^2$. In even more particular embodiments, each load-bearing fixing has a cross-section in the range of 20 $mm^2$ to 30 $mm^2$.

In a particular embodiment, the cladding fixing system includes two load-bearing screws having a round cross-section and a diameter in the range of 5 to 6 mm as the sole load-bearing fixings of the cladding fixing system.

In some embodiments, the load-bearing fixing or fixings are the only part of the cladding fixing system that extend 100% or more of the insulation material body thickness from the base plate.

The or each load-bearing fixing has a length greater than the insulation material body thickness for extending from the base plate through the insulation body material and into the load-bearing substrate. The load-bearing fixing may be any fixing suitable for fixing the base plate to the load-bearing substrate. Examples include, but are not limited to, a screw, a nut and bolt, a nail, or a tack. In preferred embodiments, the load-bearing fixing is a screw.

The load-bearing fixings may have a circular, elliptical, crescent, oval, triangular, quadrilateral (e.g. square, rectangular, rhombus, rhomboid, oblong), pentagonal, hexagonal, heptagonal, octagonal, a polygon nine or more sides, or an irregular shaped cross-section. In particular embodiments, the load-bearing fixing or fixings have a circular, oval, ellipse, square or rectangular cross-section. In a particular embodiment, the load-bearing fixing or fixings have a circular cross-section.

The load-bearing fixings may also have a base plate-engaging portion for engaging with the base plate. Typically the plate-engaging portion engages with the base plate once the load-bearing fixing has penetrated both the insulation material body and load-bearing substrate during installation.

The load-bearing fixing or fixings of the present cladding fixing system engage with the load-bearing substrate. As such, the load-bearing fixing or fixings may be described as load-bearing substrate-engaging elements. In some embodiments, the cladding fixing system may include one or more further load-bearing substrate-engaging elements configured to engage with the load-bearing substrate. In other words, the cladding fixing system may include one or more load-bearing substrate-engaging elements that are not load-bearing fixings as described herein.

In particular embodiments the further load-bearing engaging element or elements are configured to be at or protrude from the inner surface of the insulation material body, in use. In these embodiments, the further load-bearing engaging element or elements may engage with the surface of the load-bearing substrate without penetrating the surface of the load-bearing substrate. The further load-bearing engaging element or elements may be attached to one or more of the load-bearing fixings and/or may be attached to the base plate.

In particular embodiments, the load-bearing fixing or fixings of the cladding fixing system may be the only load-bearing substrate-engaging element or elements of the cladding fixing system. In this way, the cladding fixing system may include no further load-bearing substrate-engaging element or elements. In other words, the load-bearing fixing or fixings may be the only portion of the cladding fixing system configured to be at or protrude from the inner surface of the insulation material. In this way, the load-bearing fixing or fixings may be the only portion of the cladding fixing system configured to engage with the load-bearing substrate.

In some embodiments, the cladding fixing system includes a single base plate and one to five load-bearing fixings. In more particular embodiments, the cladding fixing system includes a single base plate and one to three load-bearing fixings. In further embodiments, the cladding fixing system includes a single base plate and two or three load-bearing fixings. In a more particular embodiment, the cladding fixing system includes a single base plate and only two load-bearing fixings.

Non-Combustibility

The cladding fixing system may consists of materials having a classification of A1, A2 or B according to the Euroclass System.

Examples of materials with an A1 classification include, but are not limited to, natural stone, concrete, brick, ceramic, glass, and metals, in particular steel. Examples of materials with an A2 classification according to the Euroclass system include, but are not limited to, materials with a classification of A1 including up to 10% wt. of organic compounds. Examples of materials with a B classification include, but are not limited to, gypsum boards with surface linings and fire retardant wood products.

In particular embodiments, the materials of the cladding fixing system have a classification of A1 or A2 according to the Euroclass system. Classification A1 and A2 are the two highest classifications in the Euroclass system and are classed as non-combustible. Such materials are particularly useful where the cladding fixing system is to be used in buildings having (i) four or more floors or (ii) one to three floors and a height of at least 15 metres. In some embodiments, the building has a height of a height of at least 15 metres. In general, such buildings may be classified as high-rise buildings.

In more particular embodiments, the materials of the cladding fixing system are metal.

In a particular embodiment, the materials of the cladding fixing system are selected from the group consisting of aluminium and steel.

Cladding System

In particular embodiments, the cladding fixing system is a rainscreen cladding fixing system. The rainscreen cladding fixing system is configured to fix rainscreen cladding to the exterior of a building. Rainscreen cladding typically includes one or more cladding rails and one or more cladding panels as described herein. Typically a void between the cladding panels and the insulation material body is created in rainscreen cladding systems, in use.

Method of Installing the Cladding System

Described herein is also a method of attaching a cladding structure to a load-bearing substrate of a building. The method includes the steps of:

a) Attaching one or more insulation material bodies as described herein to the load-bearing substrate of the building;
b) Attaching one or more cladding fixing systems as described herein through the insulation material body to the load-bearing substrate of the building; and
c) affixing a cladding panel structure to the cladding fixing system.

In particular embodiments, steps (a) and (b) occur simultaneously. In other words, the method of attaching the cladding structure to a load bearing structure of a building may include a single step of attaching the insulation material body and cladding fixing system to the load-bearing substrate together.

The insulation material body or bodies may be attached to the load-bearing substrate of the building with an adhesive coating on at least a load-bearing substrate abutting face of the insulation body. Such adhesives are known per se, and is typically an adhesive advised by the insulation material manufacturer (e.g. as advised by FOAMGLAS® for FOAMGLAS® cellular glass insulation materials. The adhesive typically only provides a temporary fix of the insulation material to the load-bearing substrate of the building. The load-bearing fixings of the cladding fixing system described herein may provide a permanent fixing of the insulation material body to the load-bearing substrate.

Typically, the adhesive is non-combustible (class A1 or A2 in accordance with EN 13501). In some embodiments, the adhesive is a mineral-based adhesive. In some embodiments, the adhesive is a glass-based mineral adhesive. In particular embodiments, the adhesive is selected from adhesives available from Foamglas®. In a particular embodiment, the adhesive is PC® 74A1. The adhesive may also be applied to surfaces of the insulation body that abut other insulation material bodies.

In some embodiments, holes for the load-bearing fixing or fixings and/or the stability flange or flanges of the cladding fixing system are cut into the outer surface of the insulation material body. The cutting of these holes may occur before or after the insulation body is affixed to the load-bearing substrate of the building. In some embodiments, the holes for the load-bearing fixing or fixings are cut into the insulation material body by the load-bearing fixing. In other words, the load-bearing fixing creates a hole in the insulation body material as it is installed in the insulation material body.

In particular embodiments, the load-bearing fixing or fixings of the cladding fixing system extend through the insulation material body before the insulation body is attached to the load-bearing substrate. In more particular embodiments, the base plate of the cladding fixing system and the cladding rail bracket are connected by the load-bearing fixings of the cladding fixing system, and the load-bearing fixing or fixings extend through the insulation material body before the insulation body is attached to the load-bearing substrate. In this way, the insulation material body and cladding fixing system are fixed to the load-bearing substrate in one step.

Alternatively, the cladding fixing system as described herein may be installed on the insulation material body after the insulation material body is affixed to the load-bearing substrate of the building with the adhesive. The insulation material abutting surface of the base plate is typically placed against the outer surface of the insulation material body. Where the cladding fixing system includes one or more stability flanges extending from the abutting surface of the base plate, the stability flanges typically penetrate the insulation material body. In this configuration, the cladding fixing system may remain on the outer surface of the insulation material body without the support of the installer of the system. The installer may then prepare the next stage of the installation process, such as installing the load-bearing fixings.

The load-bearing fixings may then be installed. In some embodiments, the load-bearing fixings will pass through apertures of the base plate and into the insulation material body. The load-bearing fixings have a length greater than the insulation material body. As such, the load-bearing fixings may also penetrate the load-bearing substrate of the building. The load-bearing fixings may also have a base plate-engaging portion that engages with the base plate once the load-bearing fixing has penetrated both the insulation material body and load-bearing substrate. In this way, the base plate of the cladding fixing system may be securely attached to the load-bearing wall of the building.

Where the cladding fixing system has a cladding rail bracket separate to the base plate, the cladding rail bracket may be affixed to the base plate. One or more channel bracket fixings may be used to affix the channel bracket to the base plate. In particular embodiments, the channel bracket may be affixed to the base plate with the load-bearing fixing or fixings of the cladding fixing system. In this way, the load from the cladding rail to the load-bearing substrate may be through the load-bearing fixings without the need for other fixings.

The separate cladding rail bracket may be affixed to the base plate before or after the base plate is placed on the exterior surface of the insulation material body. In particular embodiments, the separate cladding rail bracket is affixed to the base plate before the base plate abuts the exterior surface of the insulation material body. In this way, the cladding fixing system can be installed in a single step and the fixing of the cladding rail bracket to the base plate may not be obstructed by the insulation material body.

In more particular embodiments, the cladding fixing system includes a base plate and a cladding rail bracket affixed to the base plate by the load-bearing fixing or fixings of the cladding fixing system. In these embodiments, the cladding fixing system (base plate, cladding rail bracket and load-bearing fixing or fixings) may be affixed to the load-bearing substrate at the same as the insulation material body.

One or more cladding rails may then be affixed to two or more vertically or horizontally aligned cladding fixing systems through the respective cladding rail brackets. Typically the cladding rails are affixed to the cladding fixing systems after the cladding fixing systems are fixed to the load-bearing substrate of the building though the load-bearing fixings.

One or more cladding panels are then typically affixed to the cladding rails to form a cladding structure. The affixing of cladding panels and types of cladding panels that may be used are known per se. In some embodiments, cladding rails and/or cladding panels may have an A1 or A2 classification in accordance with EN 13501.

Panel Clad Building

The cladding system as described herein may be used on any residential, commercial or industrial building. In particular embodiments, the building has a height of 18 m or more. Such buildings are "high rise" buildings where escape from a fire presents certain challenges.

Turning to the figures, FIG. 1 shows a cladding system using a cladding fixing system of the type available from Nvelope®, while FIGS. 2 to 6 show cladding systems and parts of the cladding fixing systems as described herein.

FIG. 1 shows a schematic cut-through of an exterior of structure of a building with cladding panels. The figure shows, from left to right, the interior of the building 1, two layers of plasterboard 3*a*, 3*b*, a layer of wool acoustic insulation 5, a layer of high density cement particle board 7, two layers of plastic or wool insulation 9*a*, 9*b*, an air gap 11, a vertical cladding rail 13, rainscreen façade panels 15 and the exterior of the building 17. The vertical cladding rail 13 and rainscreen façade panels 15 are referred to collectively as the cladding structure 19.

The vertical cladding rail 13 is secured to the high density cement particle board 7 through a cladding fixing system 21 of the type available from Nvelope®. The cladding fixing system 21 extends from the vertical cladding rail 13 through the air gap and through both layers of plastic or wool insulation 9*a*, 9*b* to the high density cement particle board 7, where the bracket 21 is screwed into the high density cement particle board 7 with two vertically aligned screws 23. The bracket 21 is made of steel to provide rigidity to the bracket 21, allowing the load of the cladding structure 19 to be transferred to the load-bearing high density cement particle board 7.

When using plastic insulation material 9*a*, 9*b*, two layers of 100 mm thickness are combined with an air gap 11 of 62 mm to give a U-value of 0.13. The insulation material and the air gap create a cladding zone of 262 mm, and the bracket 21 is typically 262 mm in length. When using wool insulation material 9*a*, 9*b*, a layer of 140 mm thickness and a layer of 150 mm thickness are combined with an air gap 11 of 50 mm to give a U-value of 0.13. This results in a cladding zone of 340 mm, and the bracket 21 is typically 340 mm in length.

The cladding system of FIG. 1 uses around four brackets 21 are used per square metre of insulation material to provide adequate transfer of load from the cladding structure (namely the vertical cladding rail 13 and façade cladding panels 15) to the high density cement particle board 7. The bracket 21 is around 6 mm wide and around 40 mm deep. This results in a cross-section of around 240 $mm^2$ per bracket and a bracket cross-section of around 960 $mm^2$ per square metre of insulation material (at four brackets per square metre).

The cross-section of the brackets provides a relatively large thermally conductive path between the cladding structure and the high density cement particle board 7. As such, the configuration as shown in FIG. 1 is liable to suffer from significant thermal bridging.

Figure 2:
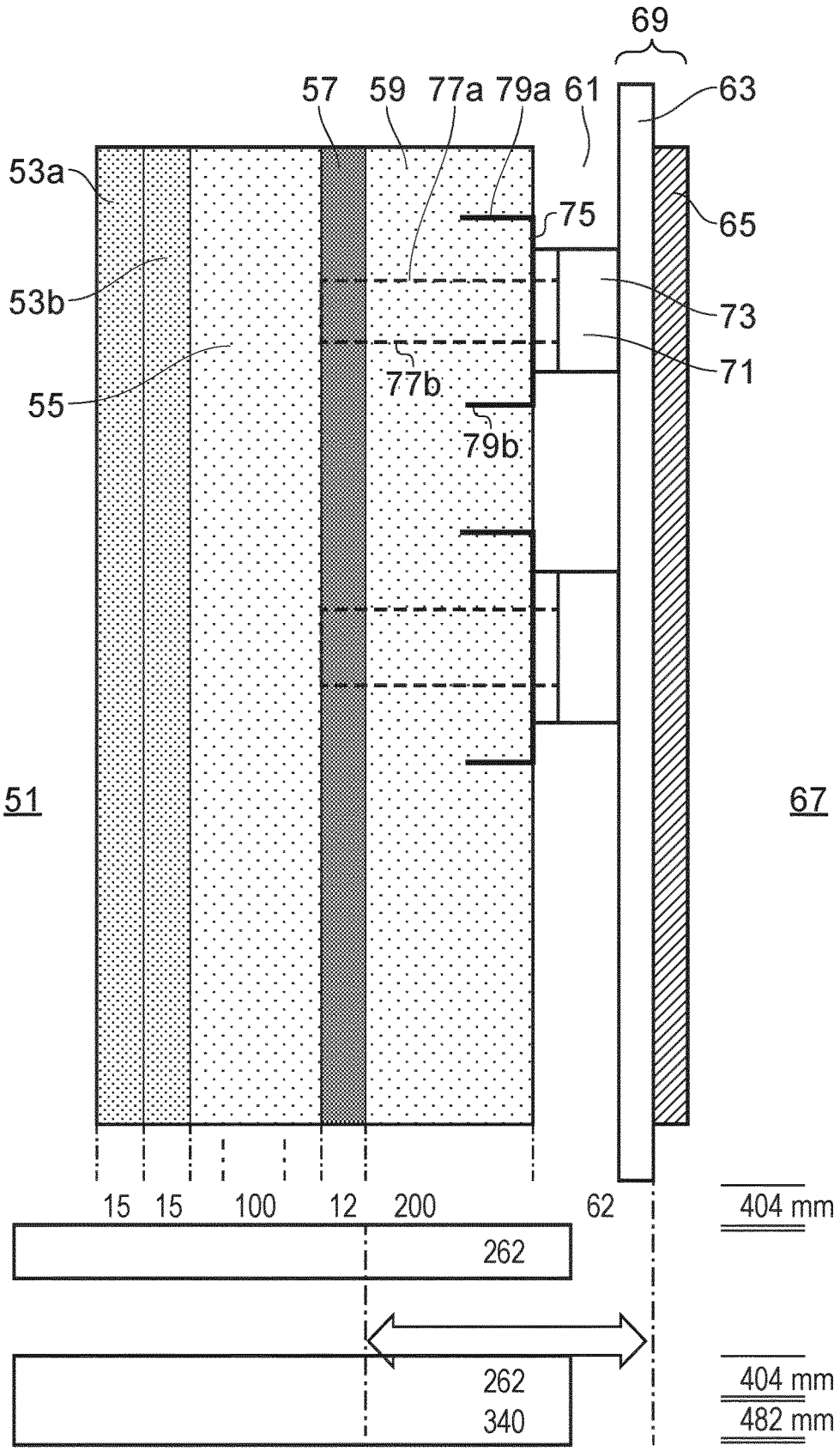
FIG. 2 shows a schematic of a cut-through showing the fixing of a cladding structure to the exterior of a building using a cladding system as described herein.

FIG. 2 shows a schematic cut-through of an exterior of structure of a building with cladding panels. The figure shows, from left to right, the interior of the building 51, two layers of plasterboard 53*a*, 53*b*, a layer of wool acoustic insulation 55, a layer of high density cement particle board 57, a layer of cellular glass insulation 59, an air gap 61, a vertical cladding rail 63, rainscreen façade panels 65 and the exterior of the building 67. The vertical cladding rail 63 and rainscreen façade panels 65 are referred to collectively as the cladding structure 69.

The vertical cladding rail 63 is secured to the high density cement particle board 67 through a cladding fixing system 71 as described herein. The cladding fixing system 71 extends from the vertical cladding rail 63 through the air gap and through the layer of cellular glass insulation 59 to the high density cement particle board 57.

A façade bracket 73 is attached to the vertical cladding rail 63 and is connected to a flat base plate 75 by two vertically aligned load-bearing screws 77*a*, 77*b*. The flat base plate 75 abuts the vertical outer cellular glass insulation layer 59. Two stability flanges 79*a*, 79*b* extend from the flat base plate 75 into the cellular glass insulation layer 59. The stability flanges 79*a*, 79*b* extend about one third of the cellular glass layer thickness. The cellular glass insulation layer 59 has a thickness of around 200 mm. In this way, a U-value of 0.13 is provided when combined with an air gap of 62 mm.

The two vertically aligned load-bearing screws 77*a*, 77*b* are steel screws with a diameter of 5.5 mm. The load-bearing screws are the only portion of the cladding fixing system that extend entirely (100%) through the insulation material. As a result, the total cross section of the cladding fixing system that extends entirely through the cellular glass insulation material is around 47.5 $mm^2$.

The cladding fixing system of FIG. 2 may be able to bear a load of up to 100 kg. The number of cladding fixing systems per square metre of insulation material may therefore be as low as one or two cladding fixing systems per square metre of insulation material. The cladding fixing systems of the cladding system of FIG. 2 may have a total cross-section extending entirely through the insulation material in the region of 50 to 100 $mm^2$ per square metre of insulation material. This is a significant reduction in cross-section compared to the system of FIG. 1 and resulting in a significant reduction in thermal bridging.

Figure 3:
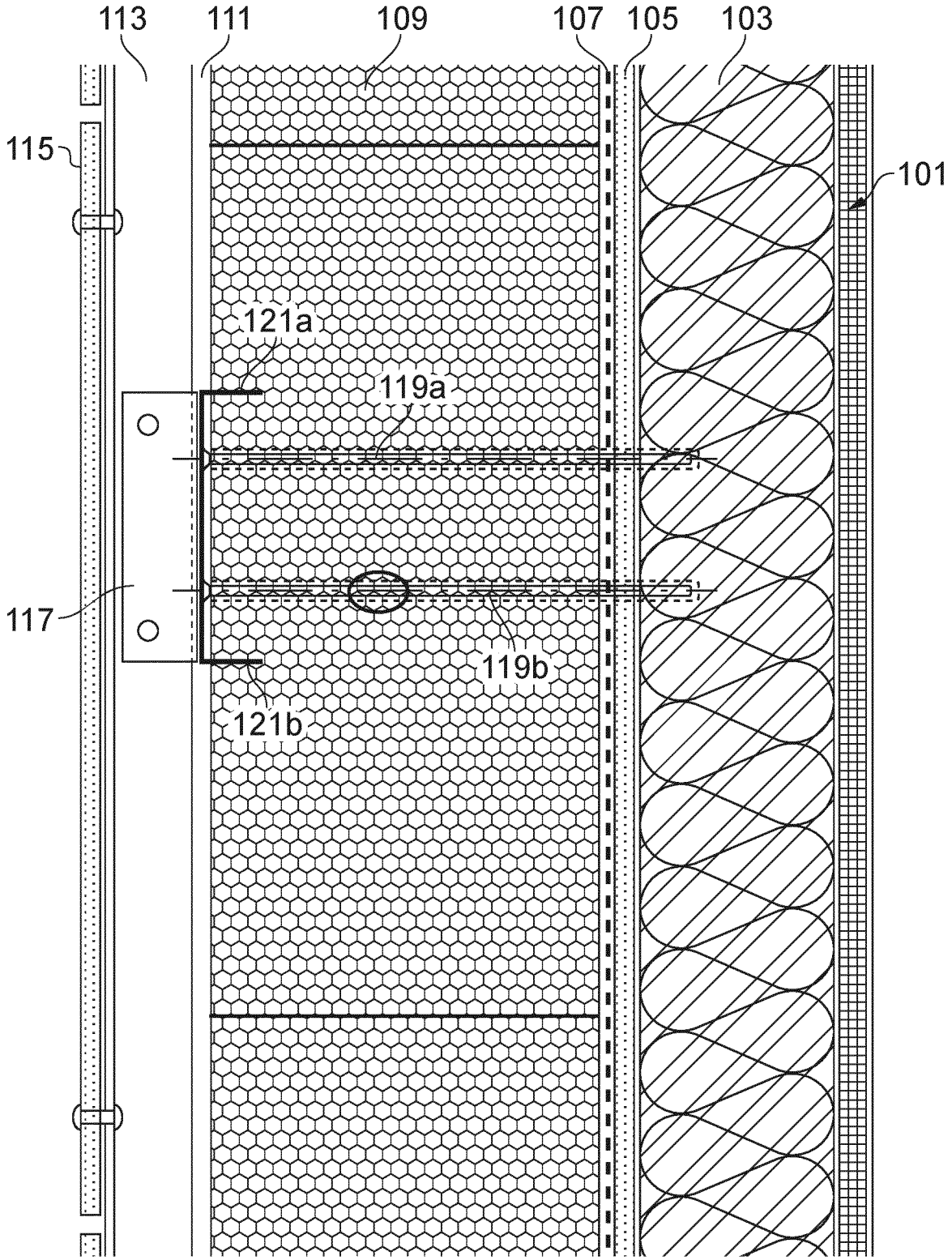
FIG. 3 shows a schematic of a cut-through showing the fixing of a cladding structure to the exterior of a building using another cladding system as described herein.

FIG. 3 shows a schematic of a cross section of a similar configuration to FIG. 2. The figure shows, from right to left, internal finishes 101, metal wall frame with mineral wool insulation infill 103, a layer of cement particle board 105, a thin layer of PC® 74 A1 FOAMGLAS® coating 107, a layer of FOAMGLAS® insulation 109, an air gap 111, a vertical cladding rail 113, and façade panels 115.

A cladding fixing system 117 is shown with load-bearing screws 119*a*, 119*b* penetrating through the FOAMGLAS® insulation 109 and into the layer of cement particle board 105.

The stability flanges 121*a*, 121*b* extend from the base plate around 10% of the FOAMGLAS® insulation 109 thickness.

Figure 4:
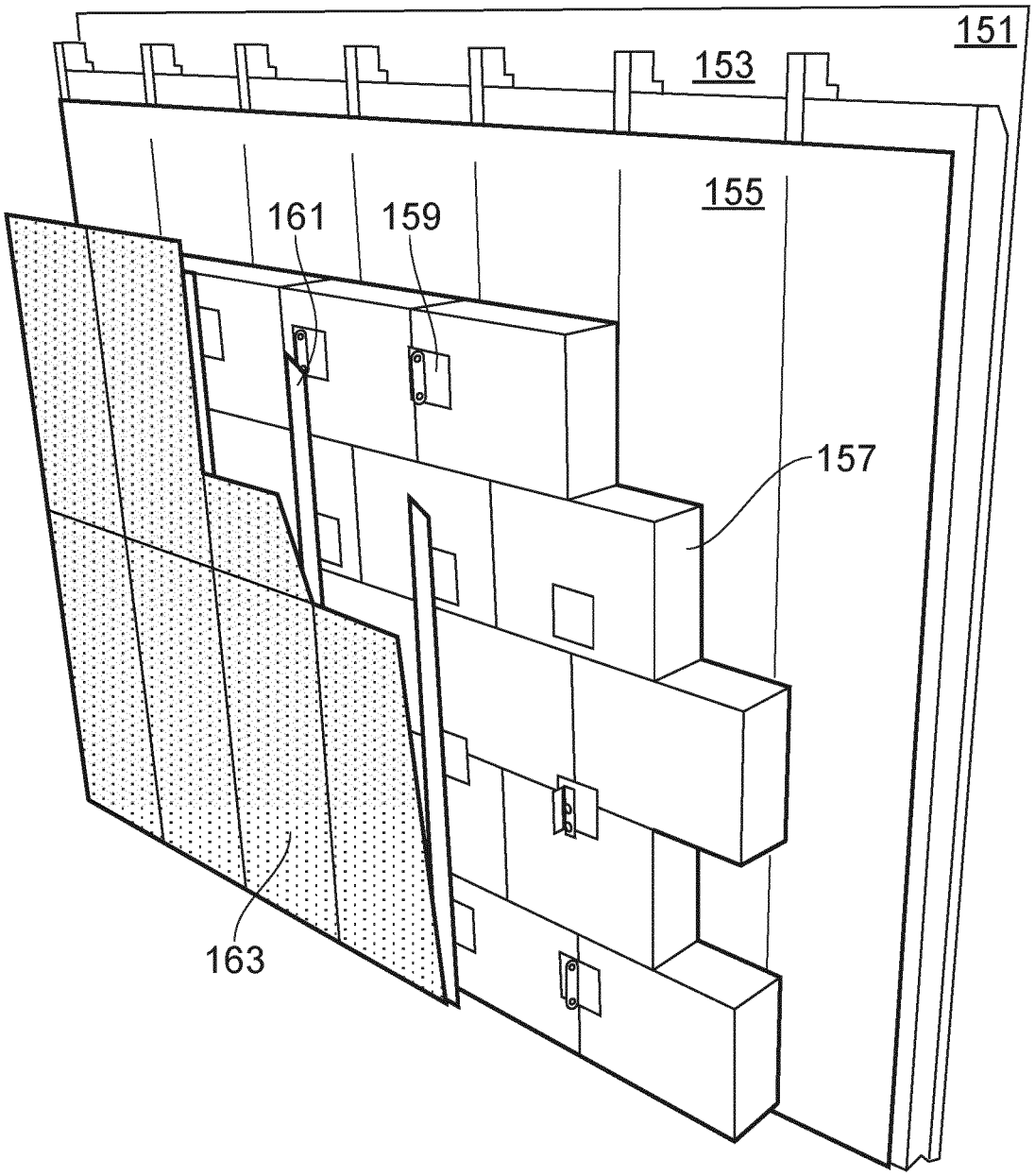
FIG. 4 shows a three dimensional schematic of the cladding system of FIG. 3.

FIG. 4 shows a 3D schematic of the cladding system of FIG. 3. The figure shows, internal finishes 151, metal wall frames with mineral wool insulation infill 153, a layer of cement particle board 155, blocks of FOAMGLAS® insulation 157, a number of cladding fixing systems 159, a number of vertical cladding rails 161, and a number of façade panels 163. The cladding fixing systems 159 are spaced periodically in horizontal rows and vertical columns. The spacing is relatively uniform to allow an even distribution of load from the façade panels 163. The vertical cladding rails 161 are affixed to a number of vertically aligned cladding fixing systems 159.

Figure 5:
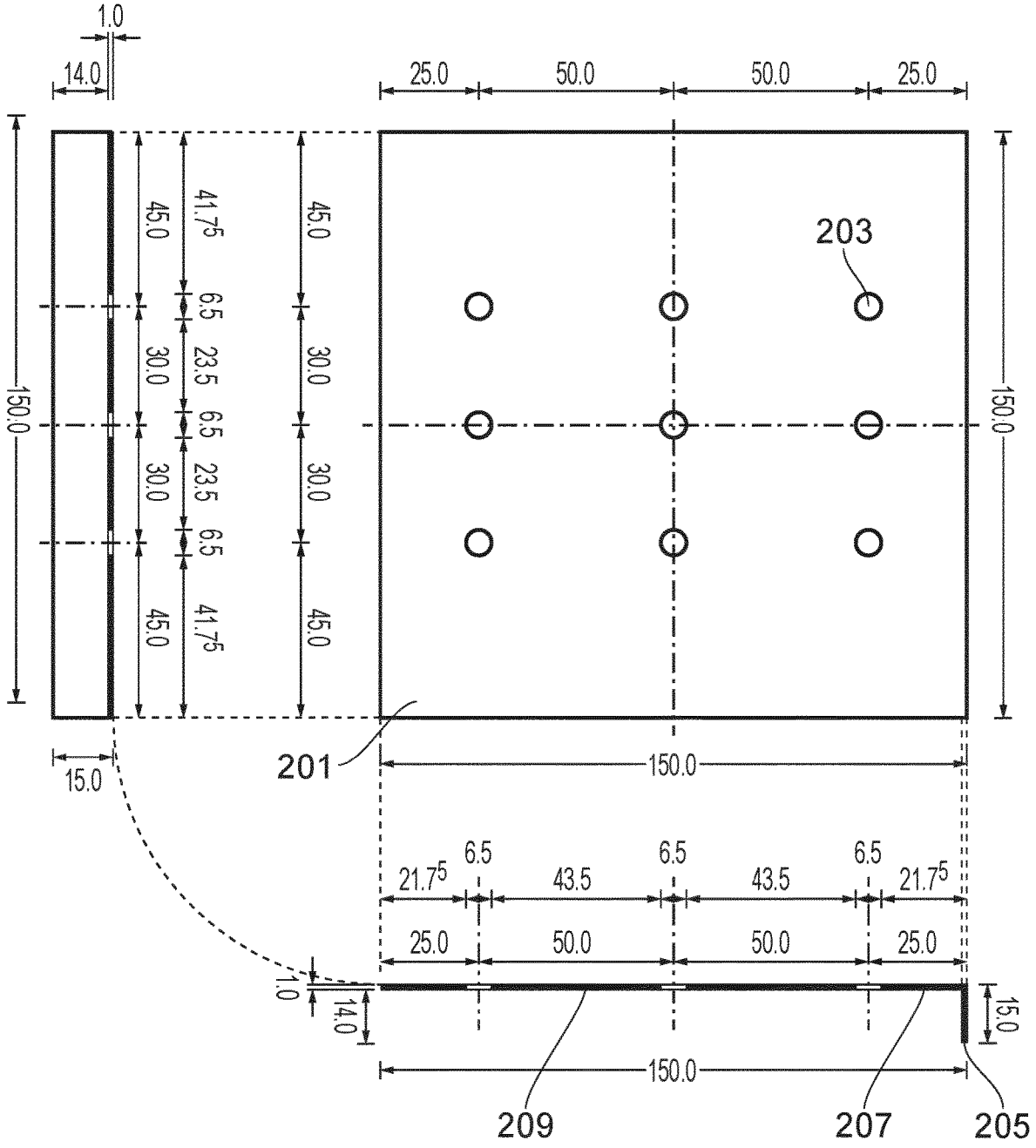
FIG. 5 shows top and side views of part of a cladding fixing system base plate useful in the cladding system as described herein.

FIG. 5 shows part of an alternative cladding fixing system. The figure shows a flat square base plate 201 measuring 150 mm long by 150 mm wide. The base plate 201 has a thickness of 1 mm. The base plate 201 has nine apertures 203 spaced as shown on the face of the base plate 201. The diameter of each aperture 203 is 6.5 mm. In this way, the base plate 201 can receive one or more load-bearing fixings (not shown) with a diameter up to 6.5 mm.

The side view shows a stability flange 205 extending from the underside 207 of the base plate 201. The stability flange 205 is located on one edge of the underside 207 of the base plate 201 and extends across the entire edge. In this way, the stability flange 205 has a width of 150 mm. The stability flange 205 extends from the underside 207 of the base plate 201 by 14 mm.

The upper side 209 of the base plate 201 may receive one or more channel brackets for engaging with a cladding rail (not shown). The channel bracket or brackets may be fixed to the upper side 209 of the base plate 201 by one or more fixings through the aperture or apertures 203. Such a fixing may be the load-bearing fixing so that the channel bracket is held to the base plate 201 through a load-bearing fixing.

Figure 6:
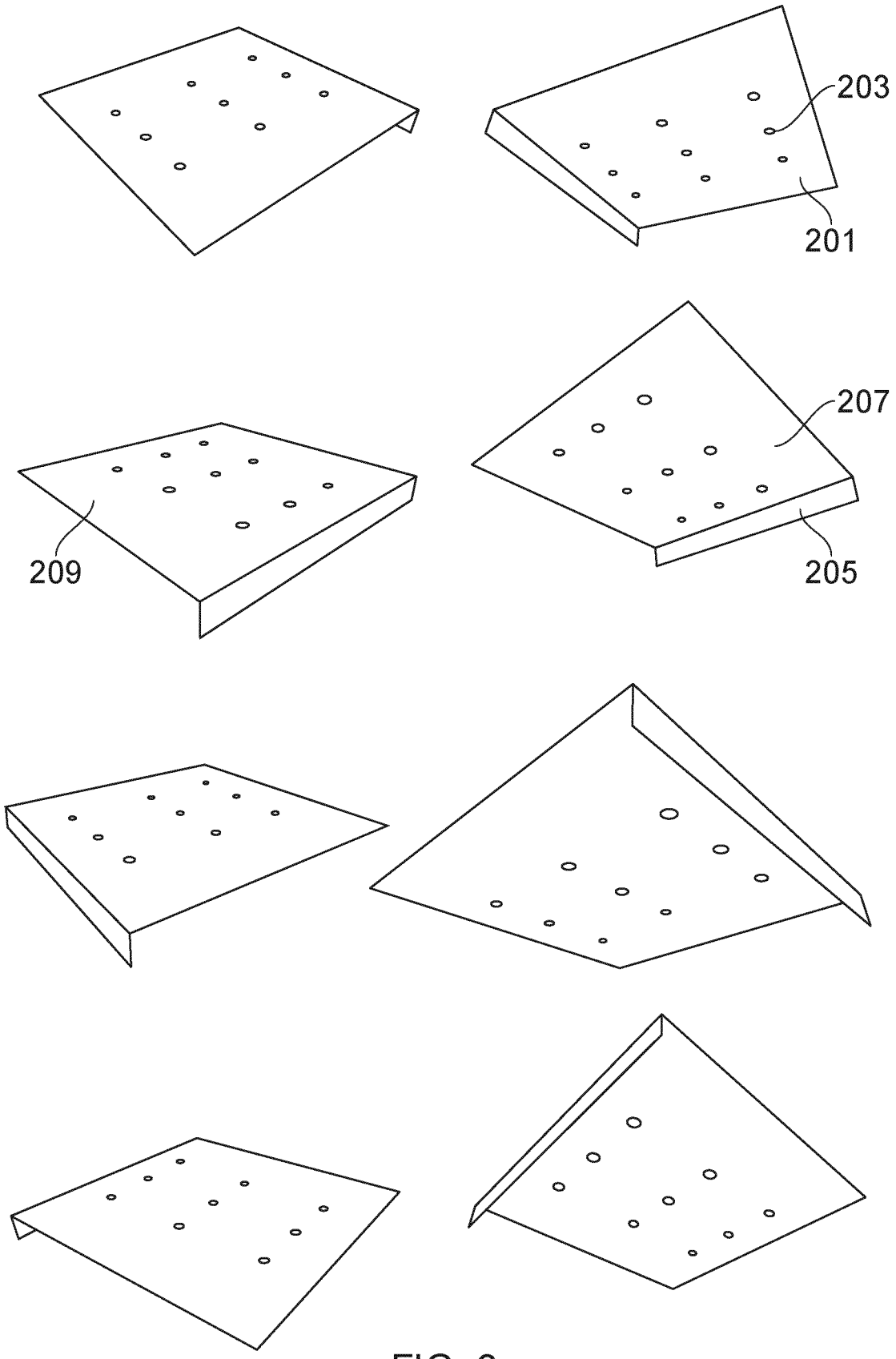
FIG. 6 shows isometric views of the part of the cladding fixing system base plate in FIG. 5.

FIG. 6 shows isometric schematic views of the part of the cladding system of FIG. 5.

REFERENCES

The following documents are incorporated in their entirety by reference:

EP 0 919 674 A1
WO 2008/142667 A1
FR 2 998 602 A1

The invention claimed is:

1. A façade cladding system comprising an insulation material body and a cladding fixing system;

wherein the insulation material body has an inner insulation material body surface for facing a load-bearing substrate of a building and an outer insulation material body surface opposite to the inner insulation material body surface, and the insulation material body has an insulation material body thickness as measured from the inner surface to the outer surface of the insulation material body, and the insulation material body exhibits less than 10% deformation under a compressive pressure of 400 kPa as measured by in accordance with EN 826;

wherein the cladding fixing system has a base plate with an insulation abutting surface for abutting the outer surface of the insulation material body, and at least one thermally conductive load-bearing fixing extending from the base plate and for fixing the base plate to the load-bearing substrate through the base plate;

wherein the cladding fixing system further includes one or more thermally conductive stability flanges extending from the insulation abutting surface, with each stability flange extending no more than 75% of the insulation material body thickness;

wherein the at least one load-bearing fixing has a length greater than the insulation material body thickness for extending from the base plate through the insulation body material and into the load-bearing substrate;

wherein a total cross section of the at least one load-bearing fixing of the cladding fixing system is less than 500 $mm^2$ per square meter of the insulation material body; and wherein the at least one load-bearing fixing is the only part of the cladding fixing system that extends from the base plate through 100% of the insulation material body thickness.

2. The façade cladding system according to claim 1, wherein the total cross section of the at least one load-bearing fixing of the cladding fixing system is 250 $mm^2$ or less per square meter of the insulation material body.

3. The façade cladding system according to claim 1, wherein the insulation material body thickness is in the range of 150 mm to 250 mm.

4. The façade cladding system according to claim 1, wherein the insulation material body is cellular glass.

5. The façade cladding system according to claim 1, wherein a total cross section of the at least one load-bearing fixing is 100 $mm^2$ or less per square meter of the insulation material body.

6. The façade cladding system according to claim 1, wherein the at least one load-bearing fixing is the only part of the cladding fixing system that extends 100% or more of the insulation material body thickness from the insulation abutting surface of the base plate.

7. A building comprising the facade cladding system according to claim 1.

8. The building according to claim 7, wherein the building has at least one of (i) four or more floors and (ii) one to three floors; and wherein the building has a height of at least 15 meters.

9. The façade cladding system according to claim 1, wherein the insulation material body comprises a first layer of insulation and a second layer of insulation; and wherein the first layer of insulation and the second layer of insulation are adjacent to one another.

10. The façade cladding system according to claim 9, wherein the first layer of insulation defines the inner insulation material body surface; and wherein the second layer of insulation defines the outer insulation material body surface.

11. The façade cladding system according to claim 9, wherein the first layer of insulation and the second layer of insulation are different insulation materials.

12. The façade cladding system according to claim 1, wherein the base plate is thermally conductive.

13. The façade cladding system according to claim 1, wherein a length of the base plate is in the range of 20 mm to 300 mm.

14. The façade cladding system according to claim 1, wherein a width of the base plate is in the range of 20 mm to 300 mm.

15. The façade cladding system according to claim 1, wherein a thickness of the base plate is in the range of 0.1 mm to 10 mm.

* * * * *